US007341631B2

(12) United States Patent
Fellinger

(10) Patent No.: US 7,341,631 B2
(45) Date of Patent: Mar. 11, 2008

(54) NOZZLE ASSEMBLY FOR SPRAY-ON DRY FIBROUS INSULATION

(75) Inventor: Thomas John Fellinger, Littleton, CO (US)

(73) Assignee: Johns Manville, Denver, CO (US)

( * ) Notice: Subject to any disclaimer, the term of this patent is extended or adjusted under 35 U.S.C. 154(b) by 59 days.

(21) Appl. No.: 11/043,747

(22) Filed: Jan. 26, 2005

(65) Prior Publication Data

US 2006/0162649 A1 Jul. 27, 2006

(51) Int. Cl.
*B05C 19/00* (2006.01)
*B05B 13/06* (2006.01)

(52) U.S. Cl. ..... 118/308; 118/317; 241/47

(58) Field of Classification Search ..... 118/300, 118/313, 308, 306, 317; 156/71; 239/8, 239/9, 434.5; 264/121, 128, 115, 517, 518; 425/82.1, 80.1; 241/47–59; 406/65
See application file for complete search history.

(56) References Cited

U.S. PATENT DOCUMENTS 3,085,834 A * 4/1963 Woten et al. ..... 406/53
4,187,983 A 2/1980 Boyer
4,710,480 A 12/1987 Buschmann et al.
4,773,960 A 9/1988 Vincelli et al.
4,804,695 A 2/1989 Horton
4,923,121 A 5/1990 Boyer
5,272,852 A * 12/1993 Fortin et al. ..... 52/742.13
5,402,947 A * 4/1995 Petersen ..... 241/39
5,641,368 A 6/1997 Romes et al.
5,795,517 A * 8/1998 Heisler et al. ..... 264/115
5,921,055 A 7/1999 Romes et al.
5,952,418 A 9/1999 Romes et al.

FOREIGN PATENT DOCUMENTS

JP 51-126365 * 10/1976

OTHER PUBLICATIONS

Abstract of JP'365—Derwent Acc. No. 1978-44952A.*

* cited by examiner

*Primary Examiner*—Yewebdar Tadesse
(74) *Attorney, Agent, or Firm*—Robert D. Touslee

(57) ABSTRACT

Nozzles for converting clumps and nodules of dry or substantially dry fibrous insulation to pils and for spraying on the so treated and accelerated air entrained insulation pieces to form thermal and acoustical insulation in building cavities. The nozzles comprise a shredder section for reducing the size of many of the pieces of insulation to pil size and an accelerator section for increasing the velocity of a stream of air suspended pils for improved just-installed insulation integrity or strength. The shredder and the accelerator can also be combined in a single unit.

18 Claims, 7 Drawing Sheets

NOZZLE ASSEMBLY FOR SPRAY-ON DRY FIBROUS INSULATION

The present invention involves a nozzle assembly for spraying substantially dry or fully dry fibrous insulation.

BACKGROUND

It is conventional to pump or blow loose fill fibrous insulation into attics, walls, etc. of houses and other buildings. It is also known to add a binder, de-dusting oil, anti-static agent and/or fungicide to small pieces of fiberglass, mineral wool or other fibrous insulation in or near a blowing nozzle to prevent settling, sparking and mold or to reduce dust in the area of the installation during installation. Such technology can be found in U.S. Pat. Nos. 4,710,4804, 4,804,695, but as stated in U.S. Pat. No. 5,952,418, these systems suffer from problems of blockage of adhesive nozzles and/or a blowing hose. Further, these systems require a moisture content in the preinstalled product that is so high that the insulation requires a long drying time, two or more days, of the wall cavity installations before wall board can be installed if potential mold problems, such as in the paper facing of the wall board are to be avoided.

Cellulose loose fill insulation is also sprayed into wall cavities, but to make the insulation stay in the cavity and not fall out, it is necessary to penetrate it with water such that as much as 2-3 pounds or more of water exists in the insulation as installed in a standard eight foot high wall cavity formed by the standard construction of 8 foot, 2"×4" inch studs on 16 inch centers. Such an installation takes days to dry sufficiently to install wallboard. It is known to add a powder adhesive to the cellulose insulation prior to injecting water into the blow to reduce the amount of water needed to get the cellulose to stick to the wall of the cavity as disclosed in U.S. Pat. No. 4,773,960, but the just installed insulation still contains much more than 15 percent water.

It is also known to spray clumps of fiber glass insulation coated with water and a non-foaming binder into wall cavities followed by rolling at least about an inch of excess insulation thickness down to the thickness of the wall studs followed by spraying additional clumps of insulation into any thin spots or unfilled cavities and apparently again rolling excess thickness down to the thickness of the studs. As disclosed in U.S. Pat. No. 5,641,368, the installed insulation is reported to have a moisture content of less than about 35 wt. percent and moisture contents of less than 10 percent are disclosed for some examples, but it is unclear how long after installation the samples were removed for testing. When using lower moisture content, the clumps do not stick well to certain conventional linings of wall cavities and the rolled insulation tends to spring back in some areas. Also, the additional step of spraying a second time slows the building installation process. Nozzles for spraying water on or an aqueous binder onto clumps of insulation while the latter are inside the nozzle are shown in U.S. Pat. Nos. 4,923,121 and 5,921,055, but these nozzles from liquid and binder striking the inside walls of the nozzle causing fiber and particles to build up on the inside of the nozzle.

A nozzle for coating clumps of insulation after they exit the nozzle is disclosed in U.S. Pat. No. 4,187,983, but this nozzle is extremely complex requiring many costly machined parts, compressed air and two sets of jet atomizers, and the angle of the jets cannot be changed.

With concerns of mold problems in walls of various kinds of structures reaching serious levels, and installed lowest installed costs being important to commercial success, a loose fill insulation, particularly an inorganic fiber insulation, that contains a low moisture content or substantially no moisture just after installation and that will dry more rapidly to a level suitable for installing wall board is greatly needed to reduce costs of construction and to reduce the potential for mold problems. The present invention addresses these needs of a more effective nozzle and a method of using the nozzle to produce a superior and less costly just-installed insulation product.

SUMMARY OF INVENTION

The invention includes a delivery system or nozzle assembly for receiving a stream of air entrained, fully dry or substantially dry fibrous clumps, nodules, and pils and mixtures thereof, the pils making up only a small weight percent of the fibrous material, of an inorganic fibrous material from a blow hose coming from a conventional insulation blowing machine, passing the stream through a shredder to convert the much of the clumps, nodules or mixtures thereof to pils and then substantially increasing the velocity of the air entrained pils prior to spraying the pils into a cavity in a structure. The spray on insulation entering the delivery system or nozzle assembly typically contains no significant moisture (water) except for what may have been absorbed from the environment and the moisture content in the just-installed insulation product is typically less than about 5 weight percent, based on the dry weight of the installed product. When the term "just-installed" is used herein, it is meant a sprayed-in insulation product no more than 10 minutes after installation. The air suspended stream of fibrous insulation exiting the shredder section of the delivery system or nozzle assembly of the invention contains at least 50 wt. percent pils and this increased pils content is important to the sticking power of the pieces of fibrous insulation as it is consolidated in a building cavity. By fully dry is meant containing only a small amount of moisture that is absorbed by the insulation from a humid environment and is normally below 2 wt. percent. By substantially dry is meant that the moisture content of he insulation is below about 5 wt. percent.

The delivery system or nozzle assembly can also optionally comprise a means for permitting a fixed or adjustable flow rate of air outside the nozzle to enter into the moving stream of air entrained pils coming from the shredder section. The nozzle also comprises an accelerator section for increasing the velocity of the air entrained material including the pils. Finally, the nozzle can optionally have one or more devices for spraying water or an aqueous adhesive onto the moving stream of air entrained nodules and/or clumps of fibrous insulation. The nozzle can be attached, at its entrance end, to a hose connected to the blowing machine, or to a short section of more flexible working hose. The cross section of the nozzle is normally round, but can be elliptical, square, rectangular or other polygonal shape Usually the inorganic fibers are fiberglass, but other fibers including slag wool, mineral wool, rock wool, cellulosic fibers, ceramic fibers and carbon fibers are included. Ideally, the average diameter of the fibers is about 2 microns or less. The clumps or nodules are mostly smaller than one-half inch in diameter, but larger sizes can be used. Nodules are defined as very small diameter of fibrous insulation of 0.25 inch diameter and smaller. Clumps are defined as having diameters greater than the diameter of nodules and up to the conventional size of clumps in the blowing insulation industry that are typically less than about 0.5 inch in diameter. The clumps and/or nodules are produced by running mineral fiber insulation such as virgin glass fiber insulation or fiber glass insulation containing a cured binder through a hammer mill, slicer-dicer or other device for reducing material to small clumps and/or nodules as is common in the industry. The shredder section of the nozzle assembly reduces the sizes of the clumps and nodules to pils (piliform) size, i.e. to pieces whose bodies are about 0.2 inch and smaller with a majority of pils having a diameter of less than about 0.15 inch and, typically a majority of the pils having a diameter of less than about 0.13 inch or smaller. As used herein, the diameter of the pils is meant the diameter of the "body" of the pils, not the diameter to the ends of projecting fibers extending from the "body" of the pils. The projecting fibers on the pils entangle with pils of the just-installed insulation upon impact due to the velocity of the stream of pils to provide surprisingly good just-installed integrity or strength.

The clumps or nodules of inorganic fibrous insulation can also contain conventional amounts of one or more biocides, anti-static agents, de-dusting oils, hydrophobic agents such as a silicone, fire retardants, phase change material, particulate aerogel, coloring agents and IR blocking agents. The other additives, when present, are also preferably included with the clumps or nodules.

When the word "about" is used herein it is meant that the amount or condition it modifies can vary somewhat beyond that claimed so long as the advantages of the invention are realized without any unexpected differences. Practically, there is rarely the time or resources available to very precisely determine the limits of all the parameters of ones invention because to do would require an effort far greater than can be justified at the time the invention is being developed to a commercial reality. The skilled artisan understands this and expects that the disclosed results of the invention might extend, at least somewhat, beyond one or more of the limits disclosed. Later, having the benefit of the inventors disclosure and understanding the inventive concept and embodiments disclosed including the best mode known to the inventor, the inventor and others can, without inventive effort, explore beyond the limits disclosed to determine if the invention is realized beyond those limits and, when embodiments are found to be without any unexpected characteristics, those embodiments are within the meaning of the term about as used herein. It is not difficult for the artisan or others to determine whether such an embodiment is either as expected or, because of either a break in the continuity of results or one or more features that are significantly better than reported by the inventor, is surprising and thus an unobvious teaching leading to a further advance in the art.

DETAILED DESCRIPTION OF THE INVENTION

Figure 1:
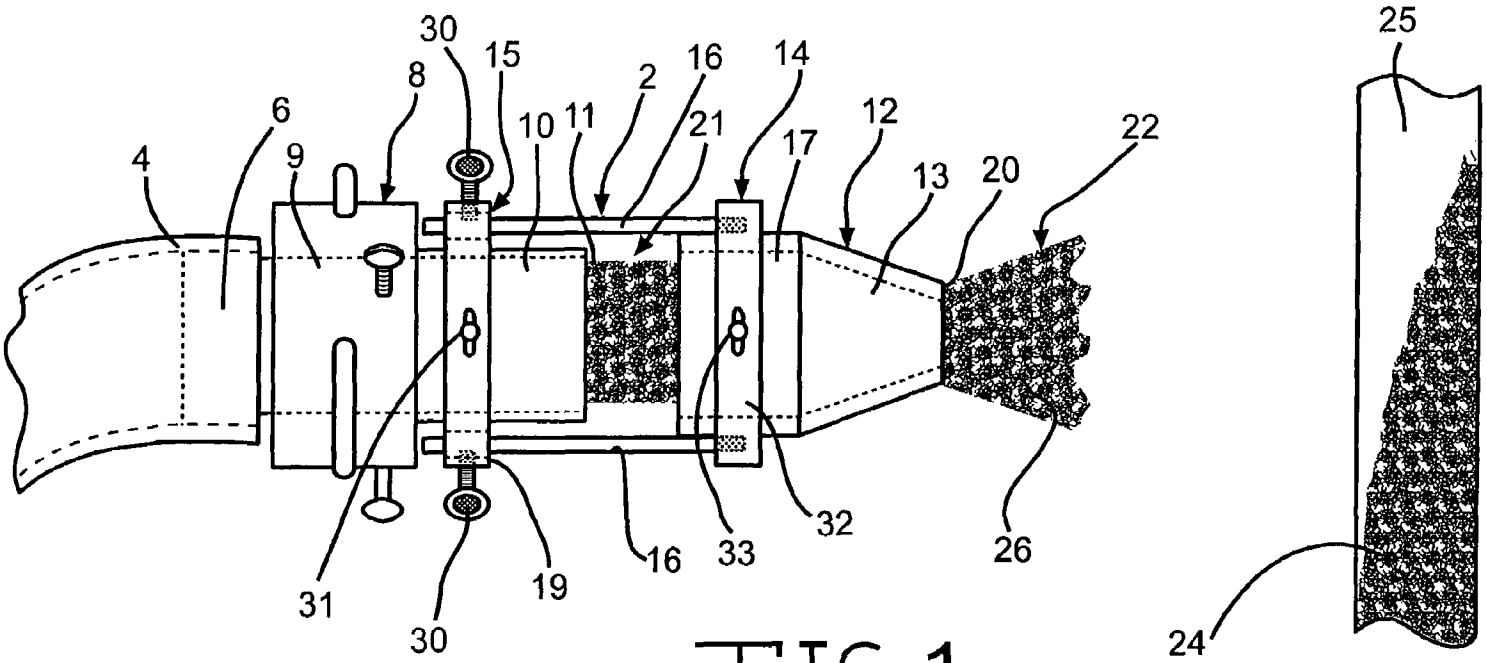
FIG. 1 front view of a nozzle used in the invention.

Blowing clumps of fibrous insulation using a blowing machine, blow hose and spraying an aqueous binder mixture onto the clumps in a hose or nozzle while in air suspension and thereafter directing the air suspension into a wall cavity to form in-wall thermal insulation between vertical studs is known, but problems have been encountered in getting the insulation to stay put in the wall cavities if the moisture content of the air entrained insulation is at a low level, particularly with just installed moisture contents below about 10 wt. percent and particularly below about 5 wt. percent.

It is known how to make loose-fill clumps, 0.5 inch diameter, of inorganic, mineral fibers for forming blown-in insulation by passing virgin fiber or scrap resin bonded fiber product through a perforated plate in a hammer mill. The inorganic and/or mineral fibers used in the present invention can be glass, mineral wool, slag wool, or a ceramic fiber and preferably is fiberglass. The loose fill clumps and/or nodules of fibrous insulation for use in the present invention is made by running virgin fiber or fiber product scrap through a conventional hammer mill, a slicer-dicer or an equivalent material processing machine. A slicer-dicer cuts or shears blankets of fibrous insulation into small cube like or other three dimensional pieces while hammer mills the like machines tear and shear virgin fiber glass or fiber glass blanket into pieces, letting only pieces below a pre-selected size out of the mill by using an exit screen containing the desired hole sizes. Virgin fiber is a fiber web or blanket made specifically for spray insulation and typically contains no resin binder.

Any type of fibrous insulation product can be processed in a hammermill, e.g. fibrous blanket in which fibers, including glass fibers, are bonded together with a cured resin, usually a thermoset resin, or a blanket of virgin fiberglass containing only de-dusting oil, silicone, anti-stat, etc. Also, the binder used to bond the glass fibers together in the blanket can also contain one or more of functional ingredients such as IR barrier agents, anti-static agents, anti-fungal agents, biocides, de-dusting agents, pigments, colorants, etc., or one or more of these functional ingredients can be applied to the fibers either before or during processing in the hammer mill or other reducing device. The size of openings in an exit screen in the hammer mill are varied to produce the desired size of clumps and/or nodules. The typical size of the openings in the exit screen range from about one inch to about three inches and a more typical size hole is about 1.25 inches.

The clumps and/or nodules of mineral fiber such as fiberglass can also derive from what is called "virgin blowing wool." This is achieved by making insulation fiber in a conventional manner except that no resin or binder is applied to the fibers. Instead, only a conventional amount of de-dusting oil and/or an anti-stat like silicone is applied to the fibers and the resultant fibrous blanket is then run through the hammer mill. Other agents can also be applied to the fibers such as a fungicide, a biocide, filler particles and/or IR reflecting particles, either immediately after fiberizing or in the hammer mill. The inorganic and/or mineral fibers used in the present invention can be glass, mineral wool, slag wool, or a ceramic fiber and typically is fiberglass.

The nodules treated by the invention are defined as very small diameter ball-like, fibrous insulation of 0.25 inch and smaller diameter and are accompanied by clumps of about minus 0.5 inch, or larger, in diameter. The average fiber diameter of the mineral fibers can be 6 microns or smaller, but typically is less than about 3 microns or smaller, more typically is about 2 microns or smaller and most typically is 1.5 microns or smaller. To produce the dry feed for the nozzles of the invention, the above described clumps and nodules are fed into a conventional insulation blowing machine that entrains the clumps and nodules in a rapidly moving air stream that exits the blowing machine via a flexible blowing hose. A typical blowing machine is a Unisul Volu-Matic® machine made by Unisul Company of Winter Haven, Fla.

A typical nozzle assembly or delivery system used in the method of the invention is shown in FIG. 1. A blow hose 4 conveys the air entrained clumps and nodules to a nozzle system 2, having an entrance end 6 attached to one end of the blow hose 4 in a conventional manner. The nozzle system 2 is comprised of a shredder section 8 having a front-end guard portion 9 and a shredder portion 10, an accelerating section 12 and an optional adjusting mechanism 14.

Figure 2:
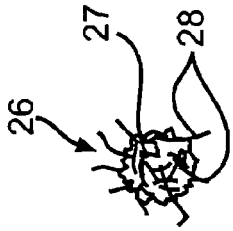
FIG. 2 is a perspective view of a pill of insulation produced by the nozzle of FIG. 1.

The shredder section 8 reduces the sizes of the clumps and nodules to pils (piliform) size, i.e. to less than pieces that are about 0.2 inch and smaller with a majority of pils having a diameter of less than about 0.15 inch and, typically a majority of the pils having a diameter of less than about 0.13 inch or smaller. A typical pils made by the shredder section 8 of the nozzle of the invention is shown in FIG. 2 As used herein, the diameter of the pils 26 is meant the diameter of the "body" 27 of the pils, not the diameter to the ends of the projecting fibers 28 extending from the "body" of the pils. The projecting fibers 28 entangle with pils of the just-installed insulation 24 due to the velocity of the stream of pils 22 to provide the surprising just-installed integrity or strength. While the shredder section 8 is shown in the drawings as being part of the nozzle, this is not essential to the invention. The shredder section could be further upstream so long as the distance is not so great after shredding that the pils reattach to each other in significant frequency that the pils amount of rebound, material that fails to stay in the cavity during or after spraying, increases significantly. The shredder section 8 is identical to the shredder section 52 shown and described below with respect to FIG. 3.

One suitable adjusting mechanism 14 is shown in FIG. 1 and is comprised of a first clamping member 15, one or more connectors 16 and a second, optional, clamping member 18. The accelerating section 12 typically has a constant diameter portion 17, whose internal diameter is greater than the internal diameter of the exit end 11 of the shredder portion 10 of the shredder section 8, is connected to a tapered portion 13 in which the internal diameter is gradually reduced from that of the constant diameter portion 17 to a reduced diameter at an exit end 20 of the tapered portion 13. The tapered portion 13 functions to increase the velocity of the moving stream of air entrained pils or piliform, insulation 22 by at least 50 percent over the velocity of the insulation in the blowing hose 4.

By "constant diameter," as used herein, means the internal diameter is substantially constant, most typically is constant within normal tolerances, but can vary by at least ± about 0.125 inch. The ratio of the internal diameter of the constant diameter portion 17 of the accelerator section 12 to the internal diameter of the shredder portion 10 of the shredder section 8 is typically in the range of about 0.25 to about 0.75. The length of the tapered portion 13 is typically within the range of about 1.5 to about 3 times the diameter of the constant diameter portion 17. The increased velocity of the stream 22 enhances a build rate of just-installed insulation 24 in a building cavity such as wall cavity 25. The increased velocity causes the pils of insulation to adhere together better upon impact, reducing rebound and providing sufficient integrity in the just-installed insulation 24 to remain in the cavity without collapsing or at least partially falling out.

The velocity is further enhanced in the nozzle 2 by permitting outside air to be inspirated into the air entrained pils stream 21 exiting the exit portion 9 of the shredder section 8. The amount of air inspirated into the stream 21 entering the accelerator section 12 is adjustable by means of the adjusting mechanism 14. The adjusting mechanism 14 is comprised of a first clamp 15 that is adjustably connected to the shredder section 8 by means of one or more movable contacting members 31, typically a thumb screw. The first clamp 15 typically at least partially surrounds the shredder section 8, but need only be attached in a laterally movable manner of any kind. A second clamp 32 is attached in some manner, fixed or movable, to the accelerating section 12. In the nozzle embodiment shown in FIG. 1, the second clamp is adjustably connected to the constant diameter portion 17 using one or more movable contacting members, typically one or more thumb screws 33. The first clamping member 15 is connected in some way to the second clamp member 32 with at least one structural member 16 that can be of most any material and any cross sectional shape, typically a circle, square, rectangle, triangle, arc, oval, and other polygonal shapes. The structural member 16 is typically fixedly attached to the second clamp 32 and slideably attached to the first clamping member 15 by passing through slots 19 running laterally through, or on the surface of, the first clamping member 15. To adjust the amount of distance between the exit end of the exit portion 10 and the entrance to the constant diameter portion 17, thumb screw(s) 30 are backed off to allow the structural member(s) 16 to slide in the slots 19, the desired distance is achieved by moving the accelerating section 12 away from or towards the shredder section 8, and when the accelerator section 12 is in a desired position, the thumb screw(s) 30 are tightened against the structural member(s) 16 to fix that position and maintain that position during operation of the nozzle 2.

Figure 3:
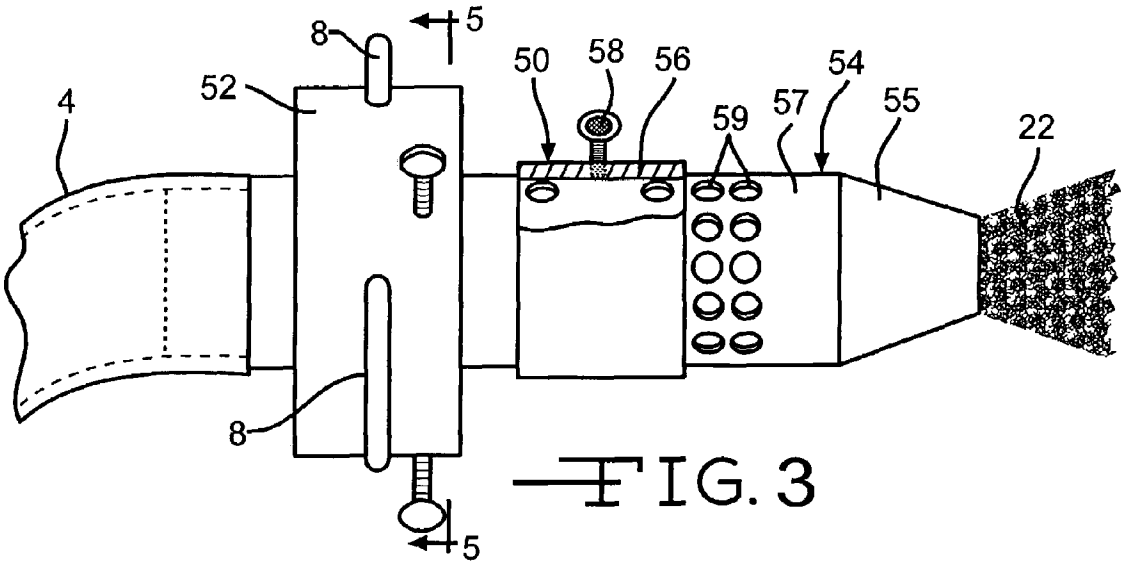
FIG. 3 is front view of another nozzle embodiment useful in the invention.

FIG. 3 shows another nozzle 50 according to the invention. The nozzle 50 comprises a shredder section 52, an accelerator section 54 having a constant diameter portion 57 and a tapered portion 55 and an adjusting mechanism 56. The shredder section is the same as the shredder section 8 of nozzle 2, but the accelerator section 54 and the adjusting mechanism 56 are different. The constant diameter portion 57 of the accelerator section 54 is longer and has a plurality of holes 59 spaced apart along the length and around the circumference of the constant diameter portion 57 to permit outside air to enter an air entrained stream of pils insulation flowing therethrough. The exit end of the shredder section and the perforated constant diameter portion 57 are a single piece. The amount of outside air that can enter the stream of the pils inslulation flow through the holes 59 is regulated by the position of the adjustment mechanism 56, a sleeve surrounding the exit portion of the shredder 52 and the perforated portion 57 in a slidable manner. Once the adjustment mechanism 56 is positioned in a desired manner, it is fixed in that position by tightening a contacting member 58, in this case a thumb screw in a threaded hole in the sleeve 56.

Figure 5:
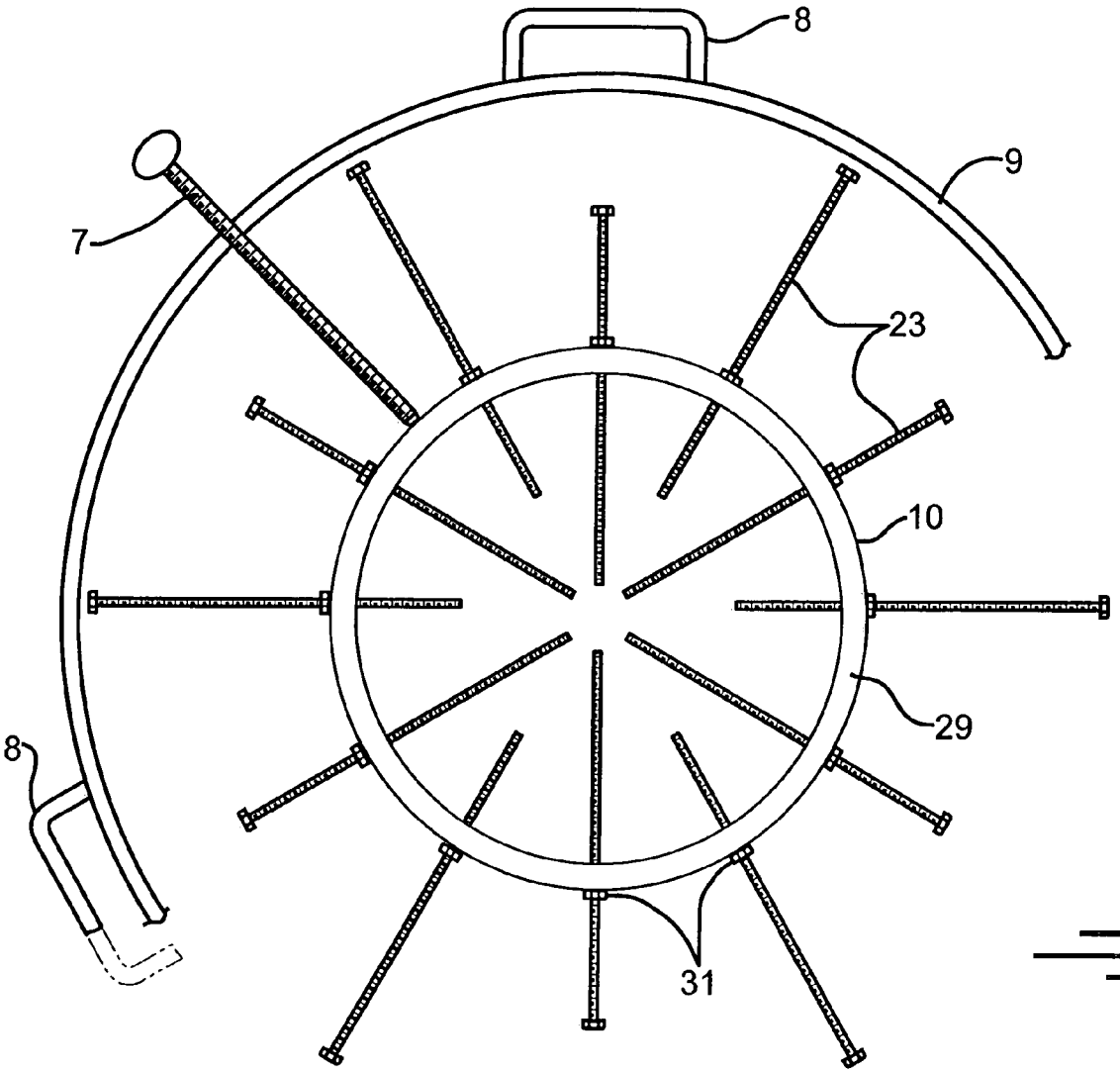
FIG. 5 is a partial cross sectional view along lines 5-5 of a shredder section of the nozzle of FIG. 1.

FIGS. 5-8 show details of a typical shredder section 8, 52 and 62. FIG. 5 is a cross sectional view of the shredder section 8 across lines 5-5. This view shows the guard portion 9 having one or more optional handles 5 and some means for releasably attaching the guard portion 9 to the shredder portion 10, such as with at least two adjustable clamping thumb screws 7 threaded either to the guard portion 9 or to nuts attached to the guard portion 9 (not shown) in a conventional manner. The thumbscrews 7 are forced against an exterior of a wall 29 of the shredder portion 10 tightly for use, but can be backed off somewhat to allow the guard portion to be slid back onto the blow hose 4 to expose adjustable shredder pins 23 that pass through the wall 29 of the shredder portion 10.

Figure 6:
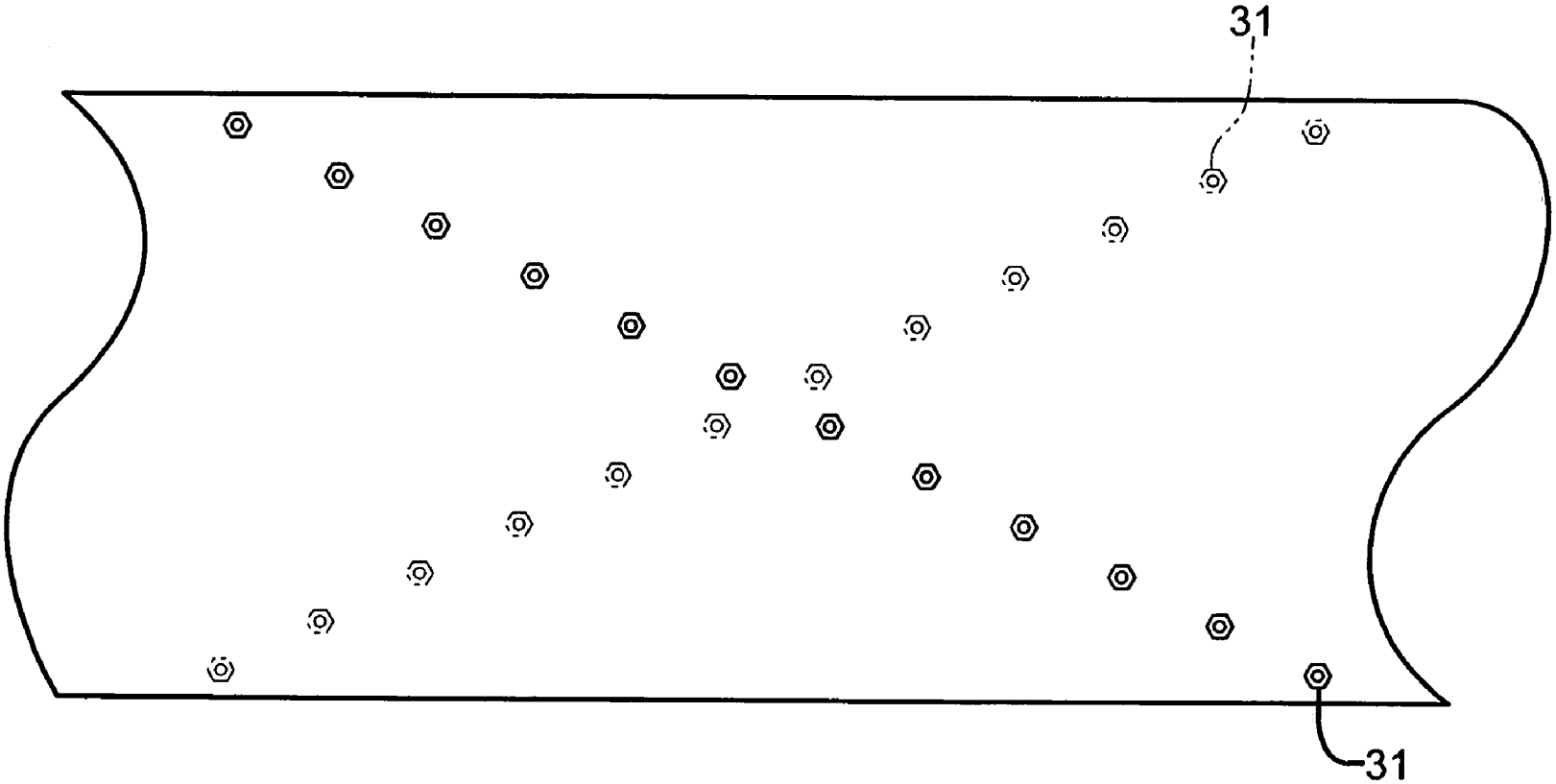
FIG. 6 is a view of the exterior of a portion of a wall of the shredder portion of the shredder section of the nozzle of FIG. 1.
Figure 7:
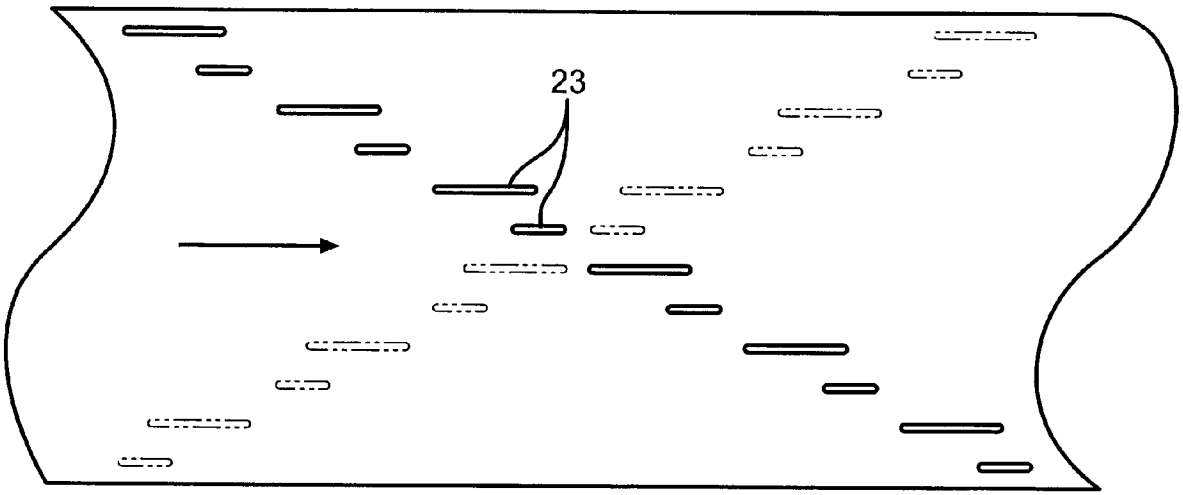
FIG. 7 is a view of a portion of the interior of the same wall shown in FIG. 6.
Figure 8:
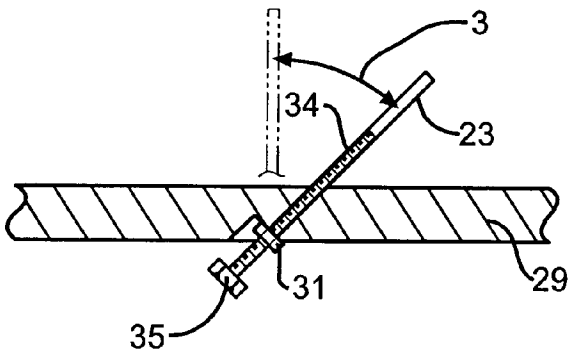
FIG. 8 is a partial cross sectional view of a portion of the shredder section showing one adjustable shredder pin passing through the wall of the shredder portion.

The shredder pins 23 enter and exit the wall 29 at an angle in the range of about 90 to about 135 degrees measured from the upstream side of each shredder pin 23, as shown in FIG. 8. The shredder pins 23 can all be oriented at the same angle or at different angles, as desired, but most typically they are all at an angle in the range of about 100 to about 135 degrees as shown by the angle 3, i.e. slanted in a downstream direction within the interior of the shredder portion 10, see FIG. 7. The shredder pins 23 can extend into the interior of the shredder portion 10 a desirable amount and this amount will vary depending upon the angle of the pins and the interior diameter of the wall 29. The shredder pins can be flexible or rigid, flexibility providing the impact force to produce pils, but flexing to more easily release any insulation that may be caught on the pin 23. Most typically the pins are metal, but can be made of other materials such as plastic, rubber and wood. Corrosion resistant steel pins are typical. The pins are adjustable using any known manner. As shown in FIGS. 5, 6 and 8, nuts 31, attached to the exterior of the wall 29 cooperate with a threaded portion 34 of each pin 23. Each pin 23 can have an optional head 35 to aid in turning the pin 23 in the nut 31. Instead of using the nuts 31, all or a portion of each hole for the, pin 23 can be threaded, or another known means of releasably gripping the pin 23 can be attached to the wall 29 of the shredder portion 10 to hold the pin 23 in place during use and to allow its adjustment. FIGS. 6 and 7 show typical patterns for the shredder pins 23 in the shredder portion 10, but other patterns are also suitable so long as they produce enough pils to cause the substantially dry insulation to be blown into a vertical wall cavity without collapsing.

Figure 4:
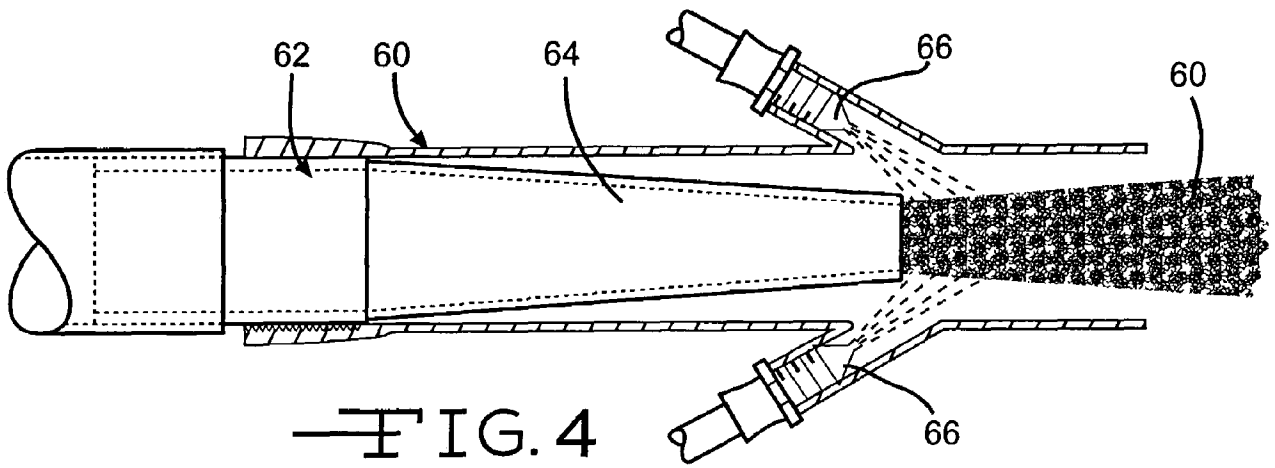
FIG. 4 is front view of another nozzle embodiment useful in the invention.

Another nozzle according to the present invention is shown in FIG. 4. The nozzle 60 is used when it is desired to spray water or an aqueous adhesive onto the pils insulation after they exit the nozzle. The nozzle 60 comprises a shredder section 62 that can be the same as the shredder section shown in FIGS. 5-8, or can be shorter with fewer breaker pins therein. When water or an aqueous adhesive is used it is not necessary to break up the clumps and nodules to such an extent as done by the nozzle of FIG. 1. The accelerator section 64 is also different as outside air is not needed because a lower pils velocity is suitable for use when the pils are moistened with water or an aqueous adhesive. The accelerator section 64 need boost the velocity of the pils coming from the shredder section only by about 10-50 percent, but can boost to an even higher velocity if needed. One or more spray jets 66 are mounted to spray water or the aqueous adhesive into the stream of air entrained pils 68. Spray jets for this purpose are known as is shown in U.S. Pat. No. 5,641,368 and 5,921,055.

To install thermal insulation using the nozzle of FIG. 4 using an aqueous adhesive, the aqueous adhesive is made up by adding the proper amount of water to a tank and then adding the proper amount of a resin, preferably a concentrated solution of the resin, to the water in the tank while optionally stirring to insure proper mixing. If a powdered resin is used, more time and stirring will be required to obtain the solution. Also, particularly when the water in the tank is cool, it may be advantageous to heat the water to at least room temperature before adding the resin. Numerous water-soluble resins can be used in the present invention, but the preferred resin is an acrylic resin, preferably an acrylic resin in concentrated solution in water, such as a concentration of about 23 percent. The most typical acrylic resin for use in the present invention is a water soluble partially hydrolyzed polyester oligomer such as S-14063 and SA-3915 available from Sovereign Specialty Chemicals of Greenville, S.C. This resin is diluted to a lower concentration when added to the water in a mixing and using tank, preferably to a concentration of less than 15 percent and most typically to about 11.5 percent. An adjustable rate pump connected to the use tank supplies the aqueous adhesive at the desired rate and pressure to the spray jet(s) 66 through one or more flexible hoses to properly coat the pils with the desired amount of aqueous adhesive. Many different types of spray jets can be used and one that performs superbly is Spray Tec's 65 degree flat spray nozzle.

The resultant just installed aqueous adhesive coated pils of mineral fiber insulation have a moisture content of less than about 5 wt. percent, based on the dry weight of the pils, more typically less than about 4 wt. percent, more typically less than about 3 wt. percent.

Figure 9:
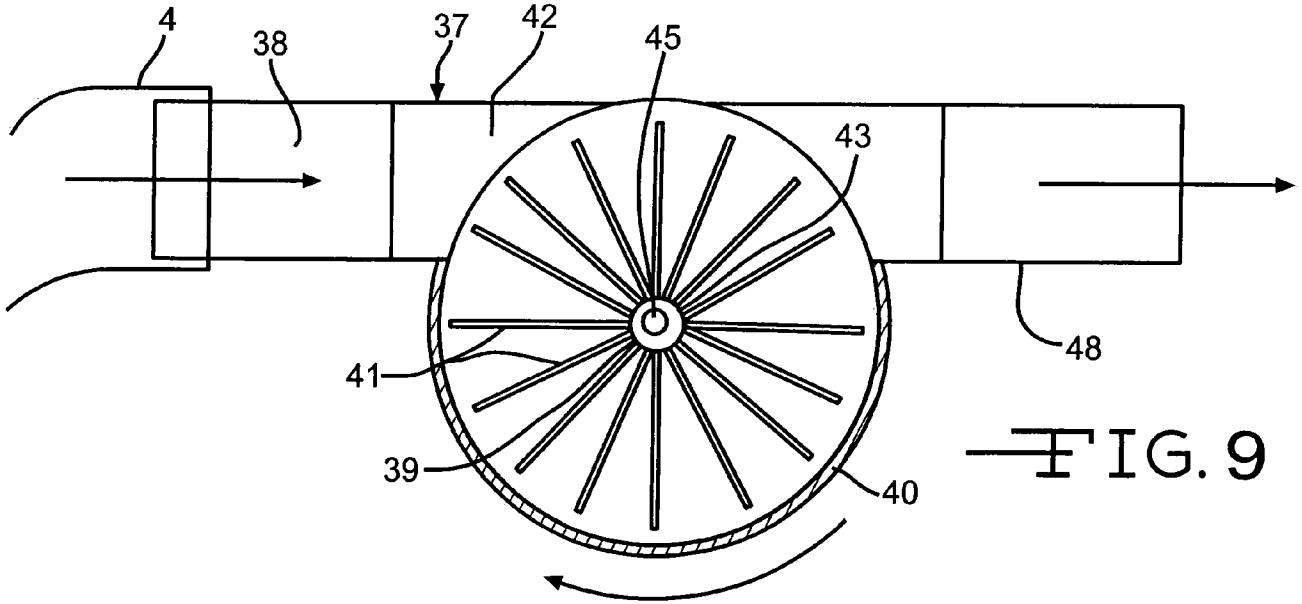
FIG. 9 is a front view of an alternative shredder section, and optionally accelerator, with a cover removed, for use alone or with the accelerator sections of FIGS. 1-3.
Figure 10:
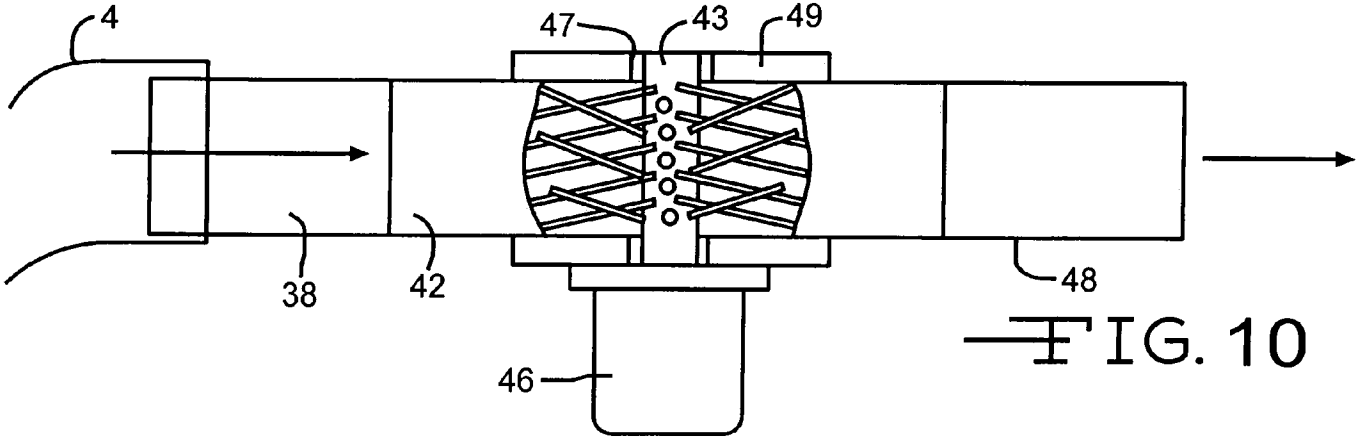
FIG. 10 is a bottom view of the alternative shredder shown in FIG. 9 with a portion removed to see the interior of the shredder.

FIGS. 9 and 10 show another embodiment of a nozzle suitable for use in the invention. This nozzle 9 connects to the blow hose 4 with a nozzle tube 38 and also comprises a pin-wheel 39 that spins inside a housing 40 and a pin-wheel tube 42, the latter being fastened to the housing 40 by any suitable manner, such as with a weld joint. A removable cover (not shown) of the housing 40 has been removed to show the pin-wheel 39. The pin-wheel 39 is comprised of a plurality of pins 41 mounted on an axle 43 that is removeably attached to a shaft 45. The shaft 45 is driven by a variable speed drive 46 and is held with bearings 47 and bearing holder 49. A portion of the top of the pin-wheel tube 42 has been removed in FIG. 10 to see the orientation of the pins 41 on the axle 43. The plurality of pins 41 can be mounted in any desirable manner to the axle 43 and can be perpendicular to the axis of the axle 43 or, as shown in FIG. 10, can be at an angle to the axis, typically at an angle in the range of about 45 to about 135 degrees with respect to the length of the axis. While one can also slant the pins 41 towards the downstream direction, when the pins 41 are top dead center, it is not necessary because the centrifugal force created by the rotation of the pin-wheel tends to throw off any pils, etc. clinging to the pins. Every other row of pins 41 in the embodiment shown in FIG. 10 are, most typically, attached at different angles than the two adjacent rows for the purpose of covering more of the cross sectional area of an the nozzle tube 37.

The variable speed of a motor 46 is such as to allow an RPM of the pin-wheel 39 to be high enough that the pins 41 impact entrained clumps and nodules of air entrained fibrous insulation with ample force to separate the nodules and clumps contacted into one or more pils. Typically the RPM capability of the pin-wheel drive will be a range of from about 1000 to about 6000 RPM. The upper portion of this RPM range will allow the nozzle 37 to also act as an accelerator for the pils and nodules and clumps resulting from impact by the pins, but not for clumps and nodules not impacted. The actual RPM used will depend upon the velocity of the air entrained clumps and nodules in the blow hose. In operation the RPM should such that the striking members of the pinwheel are moving faster than the clumps and nodules and typically at least by 1000 ft./minute and more typically at least by 2000 ft./min. The nozzle 37 can be used alone in the invention, but more typically the exit end 48 is connected to an accelerator section, such as the accelerator section 13 shown in FIG. 1.

Figure 11:
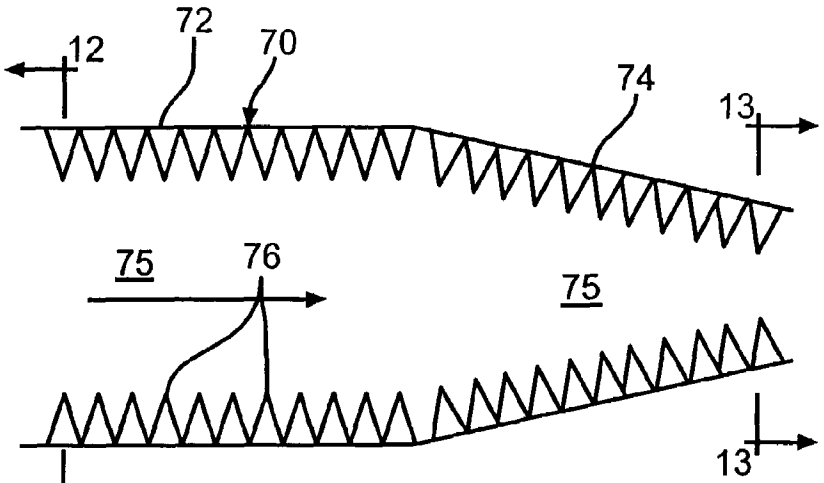
FIG. 11 is a lengthwise cross sectional view of another embodiment comprising a shredder section and shredder/accelerator section.
Figure 13:
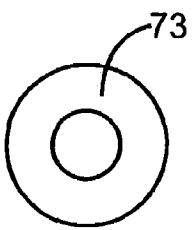
FIG. 13 is a cross sectional view of the shredder section shown in FIG. 12 along lines 13-13.
Figure 12:
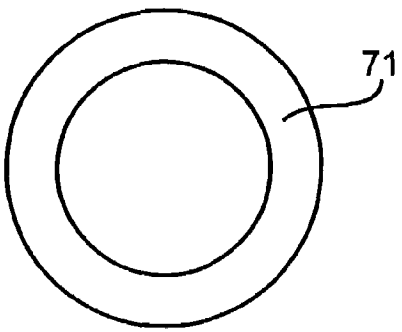
FIG. 12 is a cross sectional view of the shredder section shown in FIG. 11 along lines 12-12.

FIGS. 11-13 show another shredder and shredder/accelerator embodiment, FIG. 11 being a vertical cross section down the length of this nozzle 70. The blow hose 4 (not shown) fits around the outside of the larger, entrance end 71 of the nozzle 70. The interior 75 of the nozzle 70, including both a shredder section 72 and a shredder/accelerator section 74 is comprised of a plurality of serrations 76 on which the air entrained clumps and nodules impact to create pils. Due to turbulence caused by the serrations 76, most of the air entrained clumps and nodules of do impact points of the serrations 76 at least once during the trip through the nozzle 70. The shredder/accelerator section 74 has both serrations 76 for shredding and a decreasing cross sectional area for accelerating the pils, nodules and clumps, see FIG. 11 showing an exit end 73 of the section 74.

The nozzles systems used in the invention described above permit spraying dry or substantially dry fibrous insulation containing pils into cavities in a structure to form just-installed insulation having good integrity without having to use conventional restraining means like netting, etc. to secure the just-installed insulation in the cavities prior to applying wall board or other facing products. The absence of moisture in the dry installation eliminates the need to let the just-installed insulation alone to dry for the conventional period of at least one or two days before installing wall board—using the method of the invention permits the wall board to be installed immediately, or immediately following an optional conventional step of dressing of the just-installed insulation to remove excess thickness.

Several examples and ranges of parameters of several embodiments of the present invention have been described above, but it will be apparent to those of ordinary skill in the insulation field that many other embodiments by manipulation of the parameters following claimed invention. While most of the above discussion involves using the present invention in generally vertical wall cavities, this insulation product can be used to insulate attics or any area that can be reached with an array of the air suspended product.

The invention claimed is:

1. A delivery system comprising a nozzle assembly, the nozzle assembly capable of conveying, treating and spraying pieces of inorganic fibrous thermal and/or acoustical insulation while suspended in a stream of air and for attaching to an exit end of a blow hose, said nozzle assembly comprising a shredder section for converting some clumps, nodules and mixtures thereof of the inorganic fibrous insulation coming from a blowing machine and blow hose into pils such that at least 50 wt. percent of the pieces of inorganic fibrous insulation are in the form of pils, pieces whose bodies are about 0.2 inch and smaller with a majority of pils having a diameter of less than about 0.15 inch, and the nozzle assembly further comprising an accelerator section having a tapered portion for increasing the velocity of the stream of air suspended fibrous insulation comprising pils coming from the shredder section and for spraying the air suspended fibrous insulation into wall cavities to form in-wall thermal insulation.

2. The delivery system of claim 1 wherein the shredder section is located upstream of the accelerator section.

3. The delivery system of claim 2 wherein the accelerator section is spaced from the shredder section to permit outside air to enter the stream of air entrained pils before or as the stream enters the tapered portion of the accelerator section, the latter being joined to the shredder section with one or more structural members.

4. The delivery system of claim 3 wherein the accelerator section is connected to the shredder section with an adjusting mechanism that allows the spaced from distance between the shredder section and the accelerator section to be easily changed.

5. The delivery system of claim 2 wherein the shredder section and the accelerator section are integral or connected together, the portion of a section or portion located upstream of the tapered portion containing one or more holes to allow outside air to enter the stream of air entrained pus upstream of the tapered portion of the accelerator section.

6. The delivery system of claim 5 further comprising a movable sleeve capable of covering at least most of the holes for adjusting the amount of outside air that can enter the stream of air entrained pils.

7. The delivery system of claim 1 wherein the shredder section and the accelerator section are integral or connected together, the portion of a section or portion located upstream of the tapered portion containing one or more holes to allow outside air to enter the stream of air entrained pils upstream of the tapered portion of the accelerator section.

8. The system of claim 7 wherein the shredder section comprises a plurality of rapidly moving impacting and shredding members and a drive to cause the rapid movement.

9. The system of claim 8 wherein the rapidly moving members are moving at a rate in the range of about 1000 to about 6000 RPM.

10. The system of claim 8 wherein the rapidly moving members are moving at a rate in the range of about 3000 to about 6000 RPM.

11. The system of claim 10 wherein the rapidly moving members also serve as an accelerating section.

12. The delivery system of claim 1 further comprising one or more spray jets for spraying a liquid into an accelerated stream of air suspended pils after the accelerated stream of air suspended pus exit the tapered portion of the accelerator section.

13. The system of claim 1 wherein the shredder section comprises a plurality of rapidly moving impacting and shredding members and a drive to cause the rapid movement.

14. The system of claim 13 wherein the rapidly moving members are moving at a rate in the range of about 1000 to about 6000 RPM.

15. The system of claim 13 wherein the rapidly moving members are moving at a rate in the range of about 1000 to about 6000 RPM.

16. The system of claim 15 wherein the rapidly moving members also serve as an accelerating section.

17. A nozzle assembly capable of conveying, treating and spraying places of inorganic fibrous thermal and/or acoustical insulation while suspended in a stream of air and for attaching to an exit end of a blow hose, the nozzle assembly comprising, a shredder section, an accelerator section having a tapered portion, wherein the accelerator section is connected to the shredder section with an adjusting mechanism that allows the distance between the shredder section end the accelerator section to be changed.

18. A delivery system comprising a nozzle assembly capable of conveying, treating and spraying pieces of inorganic fibrous thermal and/or acoustical insulation while suspended in an air stream and for attaching to an exit end of a blow hose, the nozzle assembly comprising a shredder section, an accelerator section having a tapered portion and one or more spray jets for spraying a liquid into air suspended pile.

* * * * *